United States Patent [19]

Weber

[11] Patent Number: 4,644,723

[45] Date of Patent: Feb. 24, 1987

[54] WALLBOARD CLIP

[76] Inventor: William R. Weber, 4200-50th Ave. NE., Seattle, Wash. 98105

[21] Appl. No.: 836,482

[22] Filed: Mar. 5, 1986

[51] Int. Cl.[4] ..... E02D 37/00

[52] U.S. Cl. ..... 52/514; 52/747

[58] Field of Search ..... 52/514, 715, 747; 411/466, 467, 468

[56] References Cited

U.S. PATENT DOCUMENTS

| | | | |
|---|---|---|---|
| 441,227 | 11/1890 | Cary | 411/466 |
| 761,569 | 5/1904 | Widdop | 411/466 |
| 1,905,616 | 4/1933 | Zanella | 52/715 |
| 1,974,819 | 9/1934 | Koerner | 411/466 |
| 2,277,758 | 3/1942 | Hawkins | 52/514 |
| 3,936,988 | 2/1976 | Miceli | 52/514 |
| 4,152,877 | 5/1979 | Green | 52/514 |
| 4,460,420 | 7/1984 | Estrada | 52/514 |
| 4,464,821 | 8/1984 | Haytayan | 411/466 |
| 4,490,956 | 1/1985 | Palacio | 411/466 |

*Primary Examiner*—Henry E. Raduazo

[57] ABSTRACT

The repair of holes in walls constructed of plaster core wallboard accomplished by installing clips around the periphery of the holes to retain patches as plaster is being applied. The clips having points pressed into the back surface of the wallboard at a distance from the edge of the holes determined by positioning lugs and patch locating lugs which project into the holes to position the patches in relation to the front surface of the wallboard.

2 Claims, 14 Drawing Figures

WALLBOARD CLIP

BACKGROUND OF INVENTION

1. Field of Invention

This invention relates to patching holes in plaster core wallboard.

2. Prior Art

References cited

United States Patents:

U.S. Pat. No. 3,675,383, July 11, 1972, Poaletti

U.S. Pat. No. 1,905,616, Apr. 25, 1953, Zanella

U.S. Pat. No. 2,207,570, Mar. 12, 1938, Burson

U.S. Pat. No. 2,157,688, May 23, 1936, Casio

U.S. Pat. No. 4,152,877, May 8, 1979, Green

German Patent:

No. 523,359, July 24, 1894, Leicht

Norway Patent:

No. 83802, June 8, 1954, Bergen

Generally when patching a hole in wallboard, the wallboard is cutout around the damage, a patch is inserted and the seams plastered over. Many times the hole, or damage, is between the wall studding leaving nothing to keep the patch flush with the inner wall face. Several methods are used to hold the patch flush with the inside wall face while applying the patching plaster. One method is to cut the patch such that a flap of paper is left around the periphery. The patch is inserted in the hole and the paper flap is then plastered over. Other methods involve mechanically fastening something behind the hole to back the patch. There are also commercially available screens, etc. to use in patching wallboard.

The present invention is an improvement over prior art because it is simpler and faster than existing methods. Clips are imbedded in the wallboard around the sides of the hole which leaves a lug, of each clip, projecting into the hole to restrain the patch flush with the inside wall surface while the patching plaster is being applied.

Another advantage of the present invention over present patented wallboard clips is that no lugs protrude into the patching plaster area to interfere with a smooth joint.

Another advantage of the present invention is in allowing wallboard patches of different thicknesses to be used. The present invention can be so designed to place the patch locating lug in, or out, from the wall face, thus allowing different thicknesses of wallboard patch.

SUMMARY OF INVENTION

The present invention applies to the repair of breaks in wallboard, particularly wallboard with a plaster core. To patch a hole in wallboard using the present invention, wallboard clips, one would proceed as follows:

1. Cutout a patch from a loose piece of wallboard large enough to cover the break in the wall.

2. Place the wallboard patch over the break, trace around the patch, then make the cutout in the wall to the outline of the patch.

3. Press the clips around the periphery of the hole using the positioning lug to guide the points and position the locating lugs properly.

4. Place the patch in the hole and hold it against the locating lugs while applying plaster.

DESCRIPTION OF INVENTION

Figure 1:
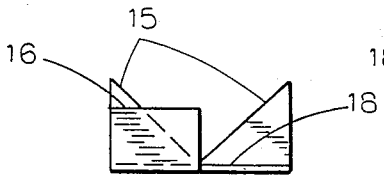
FIGS. 1 thru 2 shows a plan, side and rear view of clip.
Figure 2:
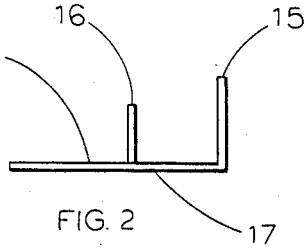
Figure 3:
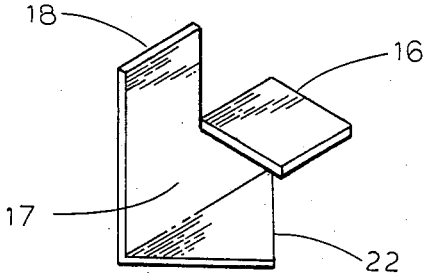
FIG. 3 is a perspective view of the clip with a single point.
Figure 5:
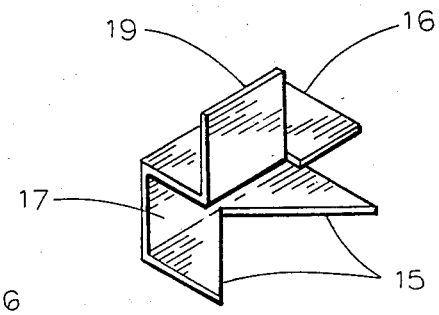
FIGS. 4 and 5 are perspective views of two versions of the clip.
Figure 4:
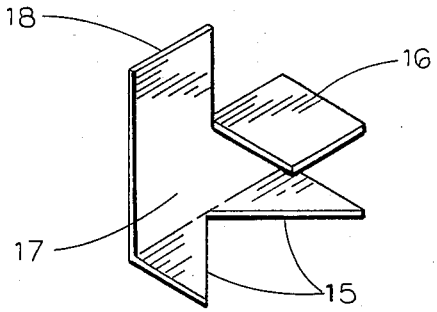
Figure 8:
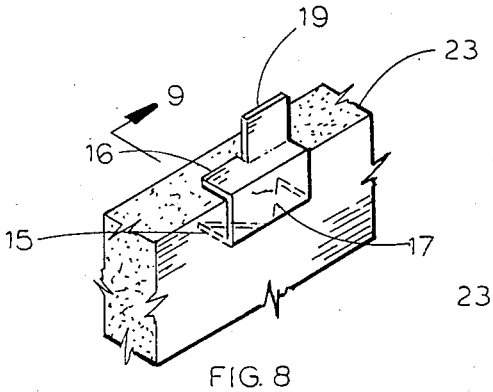
FIG. 8 is a fragment of wallboard with a second version of the clip installed.
Figure 9:
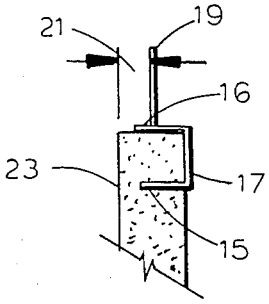
FIG. 9 is a cut thru the wallboard fragment showing a side view of the second version of the clip.
Figure 6:
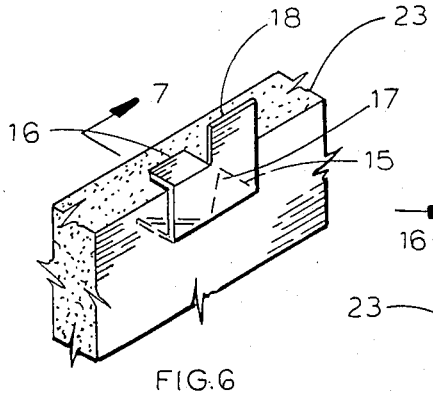
FIG. 6 shows a fragment of wallboard with the clip installed.
Figure 7:
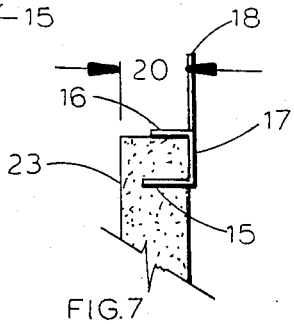
FIG. 7 is a cut thru the wallboard fragment showing a side view of the clip.
Figure 13:
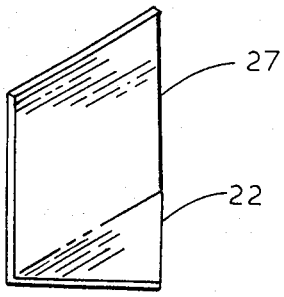
FIG. 13 is a perspective view of the clip with a single point, positioning lug 27 and without position lug 16.
Figure 14:
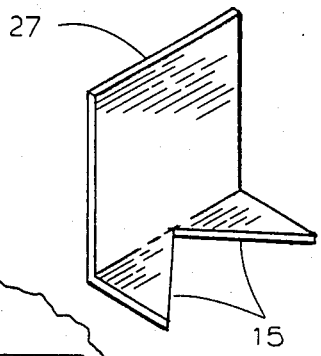
FIG. 14 is a perspective view of the clip with dual points and without positioning lug 16.
Figure 10:
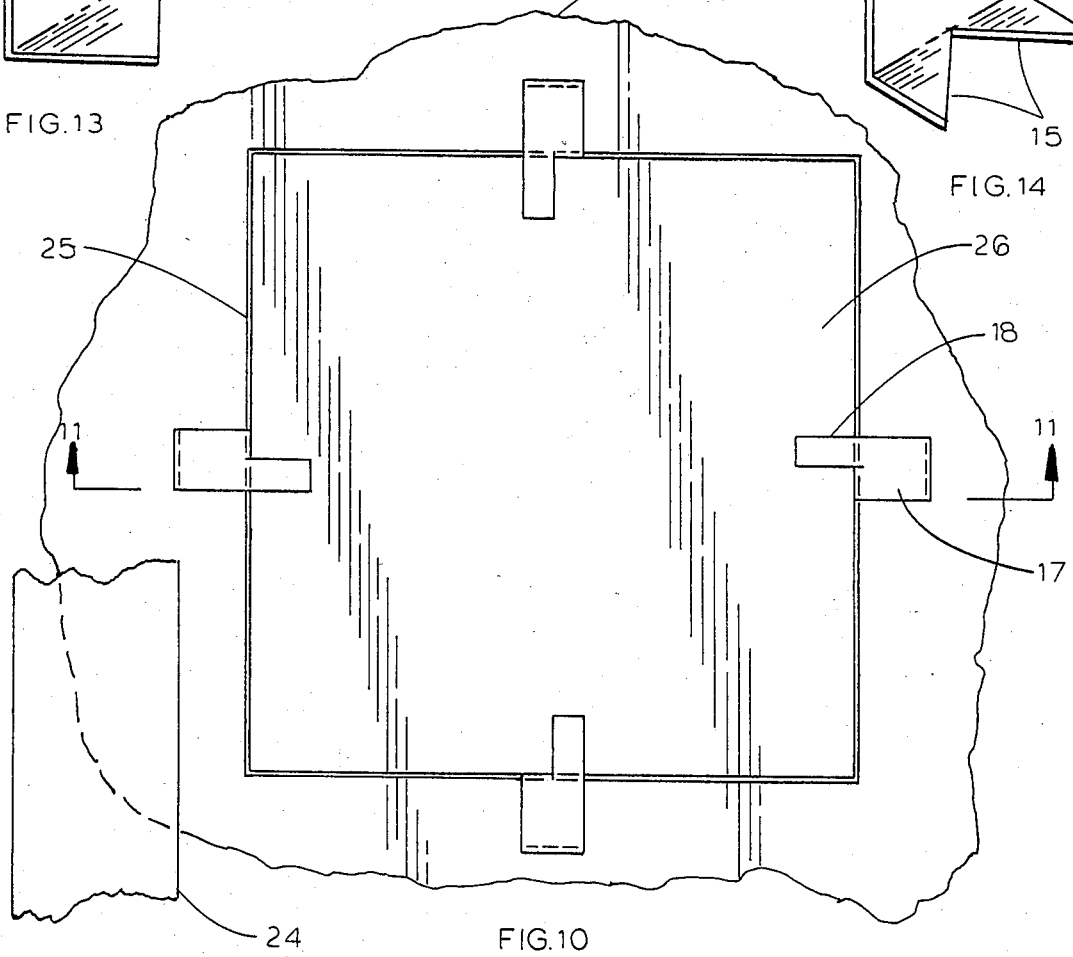
FIG. 10 shows a portion of a wallboard wall attached to a stud, with a cutout and with clips installed ready to receive a patch.
Figure 11:
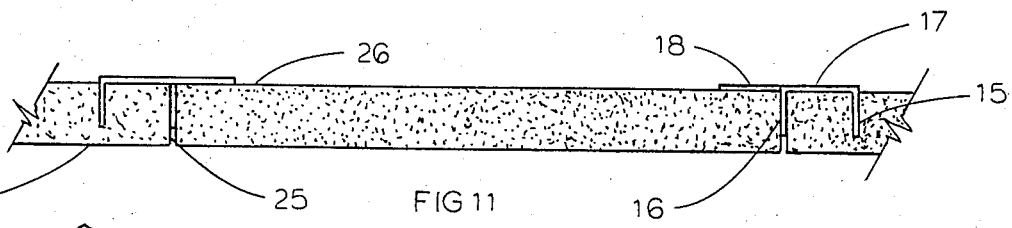
FIG. 11 is a cross section taken through a wall and patch, showing the clips installed.
Figure 12:
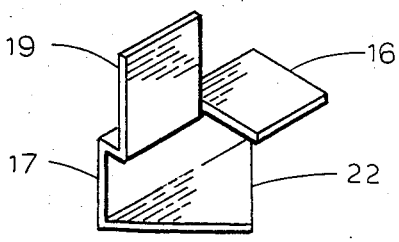
FIG. 12 is a perspective view of the clip with a single point and locating lug 19.

The drawings illustrate by way of example, not by way of limitation, two forms of the preferred embodiment of the invention wherein all reference numerals designate corresponding parts in the several views. With reference to FIGS. 1 through 2, there is illustrated the clip in two views. The clip can be formed, molded or extruded to the shape shown. The points 15 extend from the back surface 17 with a positioning lug 16 parallel to the points, also projecting from the back surface 17. A patch locating lug 18, parallel to, and extending up from the back surface 17. Locating lug 18 projects into the hole 25 to position the wall patch 26. With reference to FIG. 3 it is illustrated that the clip could be formed with one point 22 rather than the two points 15. Perspective views 4 and 5 are front views of two versions of the clip included to help visualize the form of the clip. Referring to FIG. 6 there is illustrated a fragment of wallboard with the clip installed and with a crossectional view 7 which is a side view of the clip with the points 15 imbedded from the backside, guided by position lug 16, and the patch 26 locating lug 18 allowing space 20 for the use of a wallboard patch of the same thickness as the existing wall 23. The clip can also be formed to position a locating lug 19, as illustrated in FIG. 8, such that a patch of any thickness 21 can be used. FIG. 9 shows the clip with lug 19 located to give a reduced space 21 for a patch of less thickness than the existing wallboard 23. The clips are installed around the hole 25 as illustrated in FIG. 10. FIG. 10 shows a portion of a wall having a front and back surface 23 attached to stud 24 with a hole 25. The clips are arranged around the hole with locating lugs 18 projecting into the hole and positioning lugs 16 resting on the edge of the hole. A patch 26 is inserted into the hole 25 against the locating lugs 18 and held in place while patching plaster is applied. The clip could be provided with only one lug 22 as shown in FIG. 11 and the locating lug 18 as shown or it could be provided with one point and locating lug 19 as shown in FIG. 12. The clip with two lugs 15 is superior to the clip with one lug 22. FIGS. 13 and 14 show the clip in its simplest form, no lug 16 is provided. Although the clip could be used in this form it is very inferior to the clip with positioning lug 16. If the clip were used in this configuration lug 27 would be the locating lug.

For this and other reasons it can be stated that, while the preferred embodiments of the invention have been herein described and illustrated, it should be understood that various modifications and alterations may be made without departing from the spirit of the invention or scope as defined by the appended claims.

Now, therefore, I claim:

1. A method of repairing a hole in a plasterboard wall having a front and back surface comprising the steps of:

(a) providing a plurality of wallboard clips each having a back surface with at least one point projecting at about ninety degrees therefrom, a positioning lug extending from the back surface parallel to and in the same direction as the point, and a patch locating lug extending parallel to said back surface;

(b) pressing said at least one point of each clip into the back surface of said wall about said hole using said positioning lug as a guide to space the said point at a predetermined distance from the edges of said hole with the patch locating lug extending into said hole and the at least one point and positioning lug extending at right angles to the front and back surface of said wall; and (c) inserting said patch into said hole to be supported by the patch locating lugs of the clip.

2. A wall with a front and a back side having a hold therethrough in combination with a patch and a plurality of clips, said clips having a back surface with a patch locating lug parallel thereto and at least one point and a clip positioning lug projecting in the same direction and perpendicularly therefrom, said clips installed around periphery of said hole with said at least one point pressed into the back surface of the wall at a distance from the edge of the hole determined by the positioning lug, the said patch locating lugs supporting the patch while plaster is being applied.

* * * * *